US006612690B1

(12) United States Patent
Wallace et al.

(10) Patent No.: US 6,612,690 B1
(45) Date of Patent: Sep. 2, 2003

(54) LIQUID CONTAINMENT AND DISPENSING DEVICE

(75) Inventors: James Kenneth Wallace, Toledo, OH (US); David C. Kamp, Grand Rapids, OH (US); William E. Fillmore, Toledo, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 1083 days.

(21) Appl. No.: 09/092,702

(22) Filed: Jun. 5, 1998

Related U.S. Application Data

(62) Division of application No. 08/429,987, filed on Apr. 27, 1995, now Pat. No. 5,784,087.

(51) Int. Cl.[7] ..... B41J 2/175
(52) U.S. Cl. ..... 347/86; 347/85
(58) Field of Search ..... 347/84, 85, 86, 347/87, 7

(56) References Cited

U.S. PATENT DOCUMENTS

| | | | | | |
|---|---|---|---|---|---|
| 4,053,901 | A | | 10/1977 | Skafvenstedt et al. | 347/85 |
| 4,758,456 | A | * | 7/1988 | Muscala | 428/42 |
| 5,246,147 | A | * | 9/1993 | Gross | 222/349 |
| 5,552,816 | A | * | 9/1996 | Oda et al. | 347/86 |
| 5,734,401 | A | * | 3/1998 | Clark et al. | 347/86 |

FOREIGN PATENT DOCUMENTS

| | | |
|---|---|---|
| EP | 0 437 363 A2 | 1/1991 |
| EP | 0 560 729 A2 | 3/1992 |
| EP | 0 562 717 A1 | 2/1993 |
| EP | 0 560 729 A2 | 3/1993 |
| EP | 0 650 103 A1 | 6/1994 |
| GB | 2 264 997 A | 2/1993 |
| WO | WO 95/03078 | 2/1995 |

OTHER PUBLICATIONS

International Search Report Corresponding To This U.S. Application.

* cited by examiner

*Primary Examiner*—Anh T. N. Vo

(57) ABSTRACT

An ink containment and dispensing device for an ink-jet printer is provided with a main reservoir in the form of a flexible pouch, which is typically maintained at ambient pressure. The main reservoir is coupled to a variable volume chamber via a one-way valve which allows the flow of ink from the reservoir to the chamber and prevents the flow of ink from the chamber to the reservoir. The chamber is coupled to a fluid outlet, which is normally closed to prevent the flow of outward ink. However, when the ink supply is installed in a printer, the fluid outlet establishes a fluid connection between the chamber and the printer. The chamber is part of a pump provided with the ink supply that can be actuated to supply ink from the reservoir to the printer. The pump has a linearly acting pumping member and a flexible diaphragm that overlies the pumping member, the diaphragm being impervious to the transmission of oxygen and moisture therethrough to prevent degradation of the ink within the chamber.

10 Claims, 6 Drawing Sheets

LIQUID CONTAINMENT AND DISPENSING DEVICE

This is a division of application Ser. No. 08/429,987 filed Apr. 27, 1995 now U.S. Pat. No. 5,784,087.

FIELD OF THE INVENTION

This invention relates to a liquid containment device with a self-contained pump for dispensing liquid in small doses of a predetermined volume. More particularly, this invention relates to a replaceable containment device of the foregoing character which is useful in an ink-jet printer for containing a supply of printing ink and for dispensing the printing ink to a printing head upon the actuation of the self-contained pump.

BACKGROUND AND BRIEF DESCRIPTION OF THE INVENTION

A U.S. patent application, which is being filed contemporaneously herewith by Bruce Cowger and Norman Pawlowski, Jr. for an invention entitled "Ink Supply For An Ink-Jet Printer," describes an ink supply for an ink-jet printer that is separate from the printer ink pen, and can be replaced upon the emptying of the ink supply without the need to replace the printer ink pen. The ink supply of the aforesaid U.S. patent application incorporates a self-contained pumping device for dispensing ink from a pumping chamber, and describes, as an embodiment of such a pumping device, a bellows pump. However, a bellows pump requires a relatively large extended surface of a semi-rigid material, such as a polymeric material, and is subject to a relatively high rate of oxygen and moisture transfer through the material of the bellows. This oxygen and/or moisture transfer can result in the degradation of the ink within the ink supply, especially in a printer that is used only infrequently. Further, the bellows is subject to leakage at the location of its attachment to another portion of the ink supply. However, these and other problems associated with the use of a bellows can be avoided by the use of a pumping device having a rigid perimetrical wall, preferably formed integrally with the associated chassis structure of the ink supply, with a linearly acting pumping member that is moveable within a pumping chamber defined by the rigid wall to pressurize ink within the pumping chamber, and a flexible moisture and oxygen barrier film heat sealed to an edge of the perimetrical wall in a continuous pattern and overlying the pumping member.

An ink supply according to the aforesaid U.S. patent application also has a generally cup-shaped outer shell of a fairly rigid polymeric material, preferably a material with translucent properties to permit inspection of the contents thereof, which is used to contain and protect a flexible, ink-containing pouch. The outer shell is generally rectangular in cross-section, with an opposed pair of very long sides and an opposed pair of very short sides, the configuration of the shell being determined by the design of a docking station of the printer into which the ink supply is to be inserted when it is in position for the dispensing of ink therefrom. In such an arrangement, the very long sides of such a shell are subject to warpage, which can interfere with the assembly of the ink supply into the docking station. However, it has been found that such warpage problems can be overcome by constructing the ink supply shell with an outwardly projecting bow or convex configuration, so that the cross-section configuration of the shell is approximately part elliptical rather than rectangular.

In an ink supply according to the aforesaid U.S. patent application, there is also provided a chassis to be affixed to the open end of the shell. This chassis, which houses the pump of the ink supply and has a fluid outlet for the dispensing of ink from the ink supply, must be secured to the shell in such a way that it cannot be readily disengaged therefrom. Of necessity, the chassis has a complex configuration, but can readily be formed in a single piece in such complex configuration from a polymeric material by injection molding. Of course, the chassis and the shell can be secured to each other by heat sealing if they are formed from compatible polymeric materials, but such a heat sealing step is time-consuming and expensive. However, the heat sealing step can be avoided by a snap fit between the shell and the chassis when the chassis is constructed in the form of a plug that fits snugly within the upper portion of the open end of the shell. Such a snap fit is particularly effective when the shell is constructed with an approximately part-elliptical cross-sectional configuration, as described above. While the use of a snap fit in this manner does not provide a true hermetic seal within the interior of the shell, it does retard the flow of air and moisture into and out of the shell to a sufficient extent to avoid posing degradation problems for an ink supply contained within a sealed, flexible pouch packaged within and protected by the outer shell.

An ink supply according to the aforesaid U.S. patent application also incorporates a cap of a complex configuration that is secured to the polymeric chassis, after the chassis and the flexible pouch, which is attached to the chassis, is secured to the shell with the flexible pouch contained within the shell. Because of the complexity of the cap, it is preferably formed integrally in a single piece from a polymeric material by injection molding. In any case, it is preferred that the attachment of the cap to the chassis be tamper resistant, which requires a relatively high degree of permanency to such attachment. However, it has been found that the requisite permanency in the attachment of a polymeric cap to the chassis can be readily and inexpensively obtained by providing the chassis with a spaced apart pair of outwardly projecting studs that are integrally formed with the chassis, and by providing the cap with a spaced apart pair of apertures that are aligned with the studs and receive the studs therein such that the free ends of the studs extend through the apertures in the cap and are accessible by a deforming tool such as a heated softening tool. After the attachment of the cap to the chassis, the free ends of the studs are deformed by heating them with the heat softening tool, to form buttons or caps that have outer diameters greater than the inner diameter of the apertures in the cap, thereby making it very difficult to disengage the cap from the chassis.

Accordingly, it is an object of the present invention to provide an improved liquid containing and dispensing device. More particularly, it is an object of the present invention to provide an improved device of the foregoing character that is useful in containing and dispensing ink in an ink-jet printer.

It is also an object of the present invention to provide a liquid containment and dispensing device with an improved, self-contained pumping device. More particularly, it is an object of the present invention to provide an improved device of the foregoing character that is useful in containing and dispensing ink in an ink-jet printer.

It is also an object of the present invention to provide a printing ink containment and dispensing device for an ink-jet printer having a rigid, polymeric shell of a generally rectangular cross-section that contains a flexible, ink-containing pouch, in which the longer sides of the shell are resistant to warpage. More particularly, it is an object of the present invention to provide an improved ink containment and dispensing device of the foregoing character which can be readily assembled to an associated chassis structure without the need for heat sealing the rigid shell and the chassis structure to one another.

For a further understanding of the present invention and the objects thereof, attention is directed to the drawing and the following brief description thereof, to the detailed description of the preferred embodiment of the invention, and to the appended claims.

DETAILED DESCRIPTION OF THE PREFERRED EMBODIMENT

Figure 1:
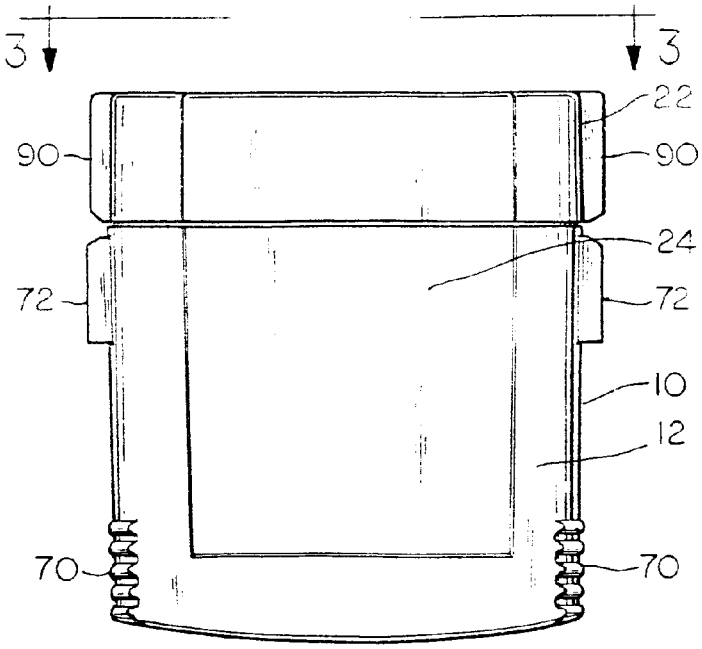
FIG. 1 is a side view of a liquid containment and dispensing device according to the preferred embodiment of the present invention.
Figure 2:
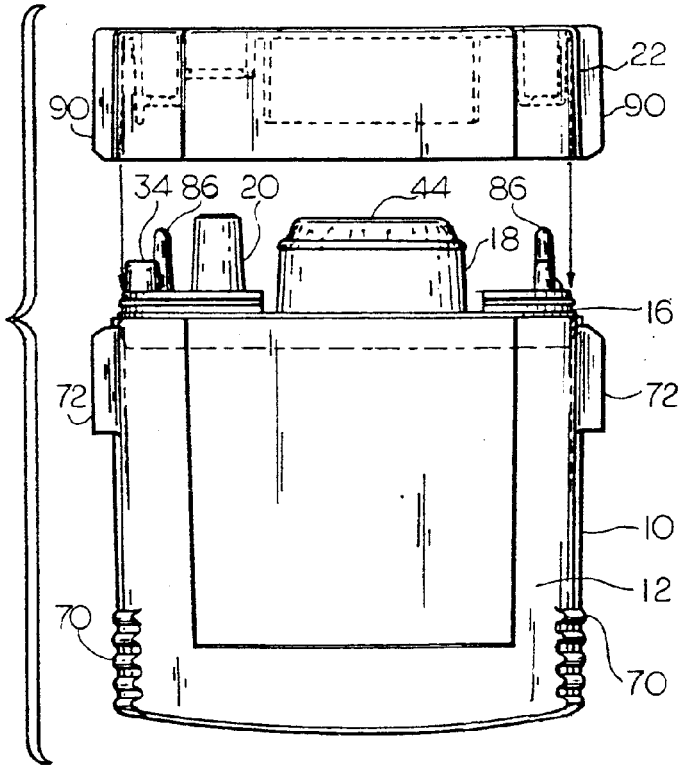
FIG. 2 is a an exploded view of the device of FIG. 1.
Figure 3:
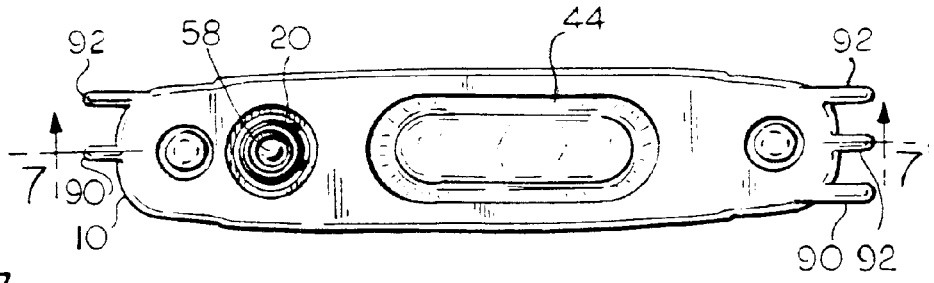
FIG. 3 is a plan view of the device of FIGS. 1 and 2 taken on line 3—3 of FIG. 1.
Figure 4:
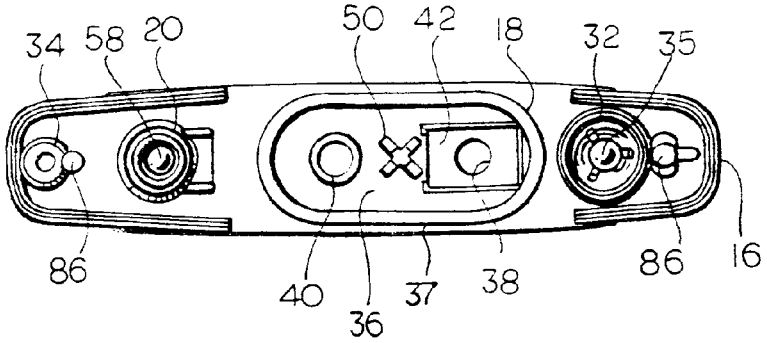
FIG. 4 is a plan view of a component of the device of FIGS. 1–3 taken on line 4—4 of FIG. 5.
Figure 5:
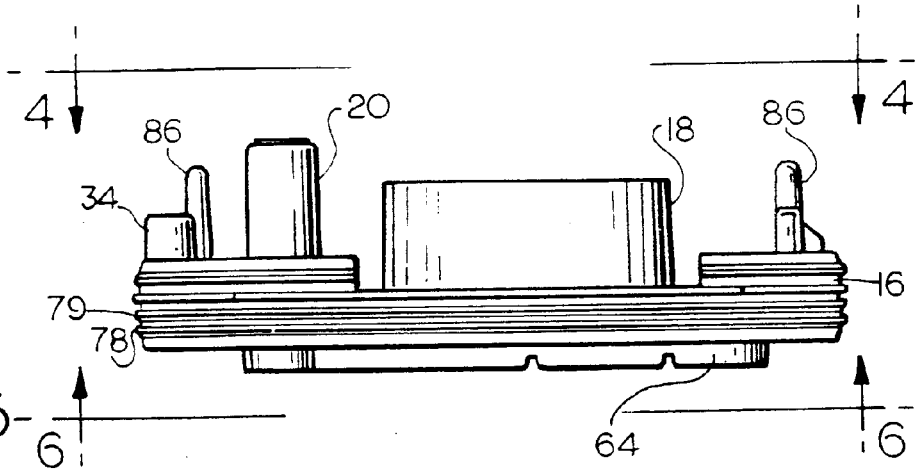
FIG. 5 is a side view of the component of FIG. 4.
Figure 6:
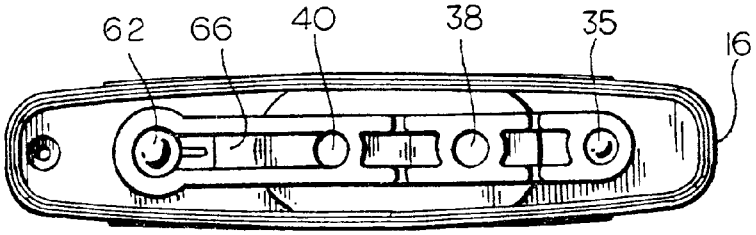
FIG. 6 is a plan view of the component of FIGS. 4 and 5 taken on line 6—6 of FIG. 5.
Figure 7:
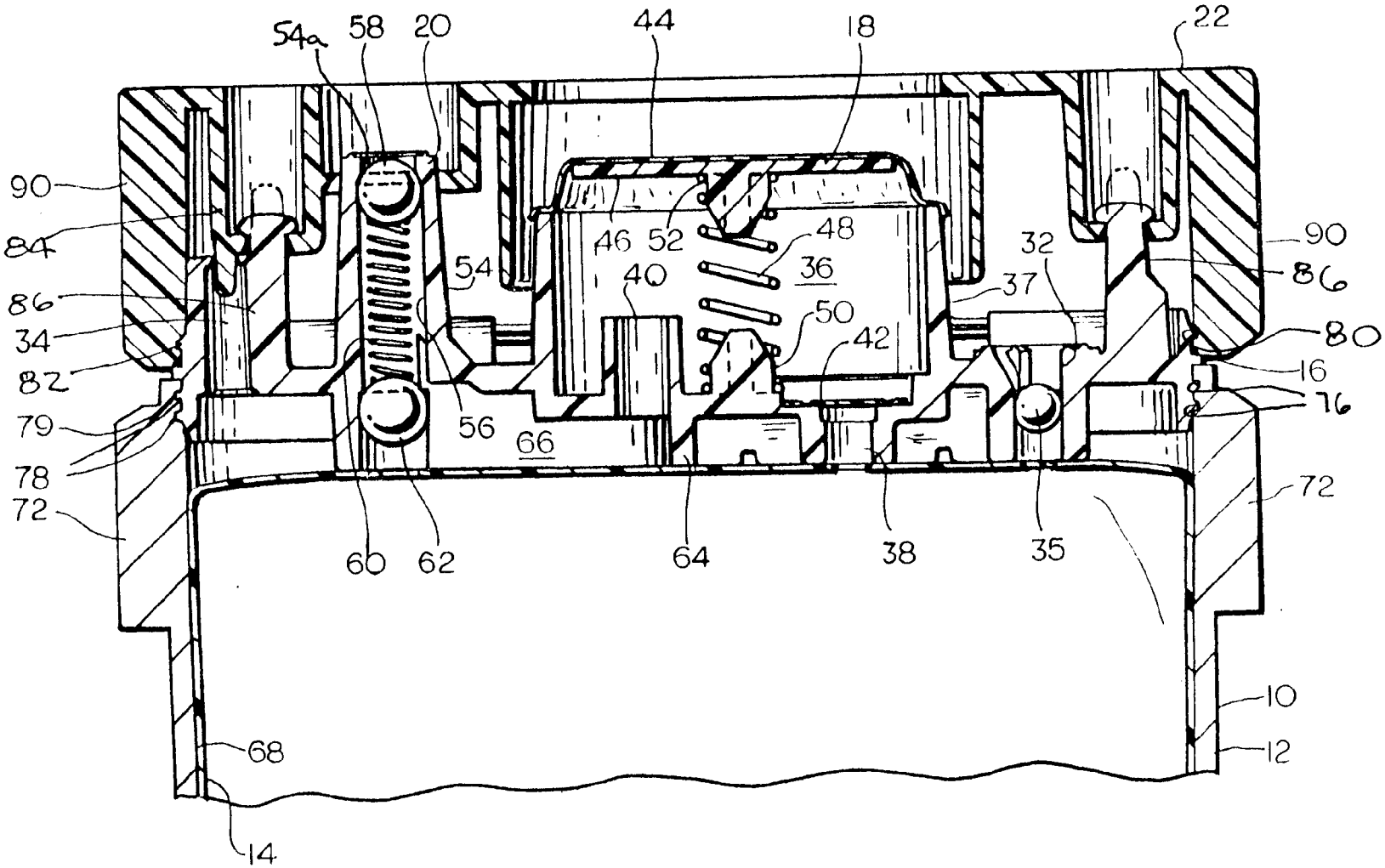
FIG. 7 is a fragmentary sectional view taken on line 7—7 of FIG. 3 and at an enlarged scale.
Figure 8:
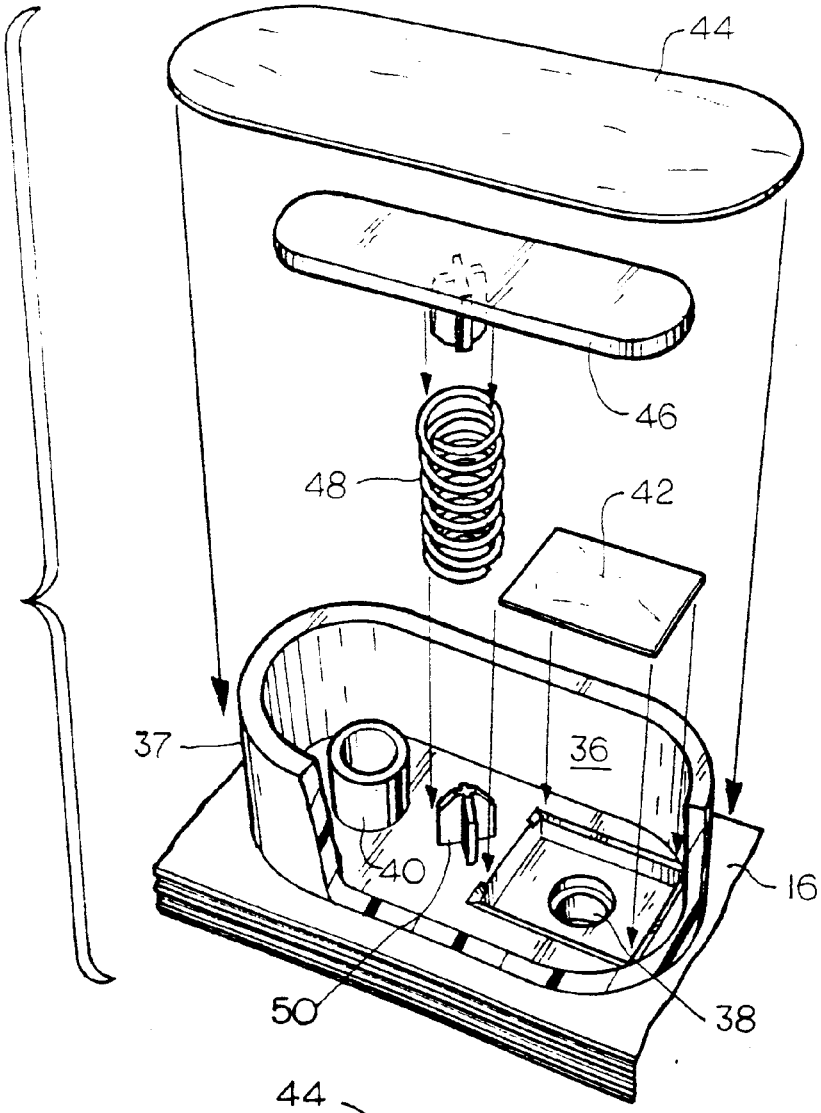
FIG. 8 is a fragmentary exploded view of a portion of the device of FIGS. 1–7.
Figure 9:
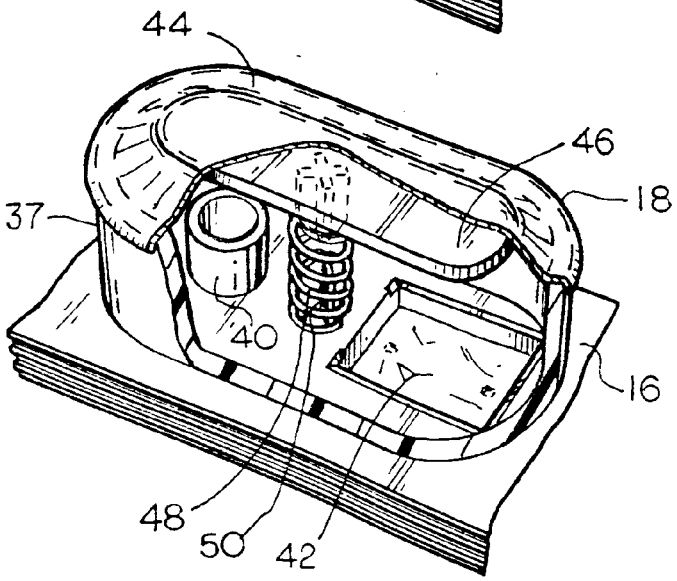
FIG. 9 is a fragmentary view similar to FIG. 8 showing the elements of FIG. 8 in assembled relationship to one another.

An ink containment and dispensing device in accordance with a preferred embodiment of the present invention is identified in FIG. 1 by reference numeral 10. The device 10 has a hard protective shell 12 which contains a flexible pouch 14 for containing ink. The shell 12 is attached to a chassis 16, which houses a pump 18 and a fluid outlet 20. A protective cap 22 is attached to the chassis 16 and a label 24 is glued to the outside of the shell 12 and cap 22 elements of the device 10 to secure the shell 12, chassis 16, and cap 22 firmly together. The cap 22 is provided with apertures which allow access to the pump and the fluid outlet.

The device 10 is adapted to be removably inserted into a docking bay (not shown) within an ink-jet printer. When the device 10 is inserted into the printer, a fluid inlet in the docking bay is adapted to engage the fluid outlet 20 to allow ink flow from the device 10 to the printer. An actuator (not shown) in the docking bay is adapted to engage the pump 18. Operation of the actuator causes the pump 18 to provide ink in a series of small doses of a predetermined volume from the flexible pouch 14, through the fluid outlet 20, to the fluid inlet of the docking bay and then to the printer.

The chassis 16 is provided with a fill port 32 at one end and an exhaust port 34 at the other end. Ink can be added to the ink supply through the fill port 32 while air displaced by the added ink is exhausted through the exhaust port 34. After the ink supply is filled, the fill port 32 is sealed with a ball 35 press fit into the fill port 32.

A pumping chamber 36 having an open bottom is formed on the bottom of the chassis 16 within a rigid perimetrical wall 37, which is preferably formed integrally with the chassis 16. As described in more detail below, the chamber 36 can be pressured to supply ink to the printer without pressurizing the interior of the pouch 14. The top of the chamber 36 is provided with an inlet port 38 through which ink may enter the chamber 36 from the pouch 14 by gravity and/or by a negative pressure within the chamber 36. An outlet port 40 through which ink may be expelled from the chamber 36 is also provided.

A one-way flapper valve 42 located at the bottom of the inlet port 38 serves to limit the return of ink from the chamber 36 to the pouch 14. The flapper valve 42 is a rectangular piece of flexible material. In the illustrated embodiment the valve 42 is positioned over the bottom of the inlet port 38 and is heat staked to the chassis 16 at the midpoints of its short sides. When the pressure within the chamber 36 drops below that in the pouch 14, the unstaked sides of the valve 42 each flex to allow the flow of ink through the inlet port 38 and into the chamber 36. By heat staking the valve 42 to the chassis 16 along an opposed pair of sides, less flexing of the valve 42 is required or permitted than would be the case if the valve 42 were staked only along a single side, thereby ensuring that it closes more securely, and this effect is enhanced by doing the heat staking at the midpoints of the shorter sides, as opposed to the longer sides.

In the illustrated embodiment the flapper valve 42 is made of a two ply material. The outer ply is a layer of low density polyethylene 0.0015 inches thick. The inner ply is a layer of polyethylene terephthalate (PET) 0.0005 inches thick. The illustrated flapper valve 42 is approximately 5.5 millimeters wide and 8.7 millimeters long. Such a material is impervious to the flow of ink therethrough when the valve 42 is in its closed position.

The bottom of the chamber 36 is covered with a flexible diaphragm 44. The diaphragm 44 is slightly larger than the opening at the bottom of the chamber and is sealed around the free edge of the perimetrical wall 37 that defines the chamber 36. The excess material in the oversized diaphragm 44 allows the diaphragm to flex up and down to vary the volume of the chamber 36. In the illustrated device, the displacement of the diaphragm 44 allows the volume of the chamber 36 to be varied by about 0.7 cubic centimeters. The fully expanded volume of the illustrated chamber 36 is between about 2.2 and 2.5 cubic centimeters.

In the illustrated embodiment, the diaphragm 44 is made of a multi-ply material having a layer of low density polyethylene 0.0005 inches thick, a layer of adhesive, a layer of metallized polyethylene terephthalate (PET) 0.00048 inches thick, a layer of adhesive, and a layer of low density polyethylene 0.0005 inches thick. Of course, other suitable materials may also be used to form the diaphragm 44. The diaphragm 44 in the illustrated embodiment is heat staked, using conventional methods, to the free edge of the wall 37 of the chamber 36. During the heat staking process, the low density polyethylene in the diaphragm will seal any folds or wrinkles in the diaphragm 44. The diaphragm 44, thus, is impervious to the transmission of oxygen and moisture therethrough, thereby safeguarding the ink in the chamber 36 from degradation by exposure to any such substance.

Within the chamber 36 a pressure plate 46 is positioned adjacent the diaphragm 44, the pressure plate 46 serving as a piston with respect to the chamber 36. A pump spring 48, made of stainless steel in the illustrated embodiment, biases the pressure plate 46 against the diaphragm 44 to urge the diaphragm outward so as to expand the size of the chamber 36. One end of the pump spring 48 is received on a spike 50 formed on the top of the chamber 36 and the other end of the pump spring 48 is received on a spike 52 formed on the pressure plate 46 in order to retain the pump spring 48 in position. The pressure plate 46 in the illustrated embodiment is molded of high density polyethylene.

A hollow cylindrical boss 54 extends downward from the chassis 16 to form the housing of the fluid outlet 20, the boss 54 being formed integrally with the chassis 16. A bore 56 of the hollow boss 54 has a narrow throat 54*a* at its lower end. A sealing ball 58, made of stainless steel in the illustrated embodiment, is positioned within the bore 56. The sealing ball 58 is sized such that it can move freely within the bore 56, but cannot pass through the narrow throat portion 54*a* thereof. A sealing spring 60 is positioned within the bore 56 to urge the sealing ball 58 against the narrow throat 54*a* to form a seal and prevent the flow of ink through the fluid outlet. A retaining ball 62, made of stainless steel in the illustrated embodiment, is press fit into the top of the bore 56 to retain the sealing spring 60 in place. The bore 56 is configured to allow the free flow of ink past the retaining ball 62 and into the bore 56.

A raised manifold 64 is formed on the top of the chassis 16. The manifold 64 forms a cylindrical boss around the top of the fill port 32 and a similar boss around the top of the inlet port 38 so that each of these ports is isolated. The manifold 64 extends around the base of the fluid outlet 20 and the outlet port 40 to form an open-topped conduit 66 joining the two outlets.

The flexible ink pouch 14 is attached to the top of the manifold 64 so as to form a top cover for the conduit 66. In the illustrated embodiment, this is accomplished by heat staking a rectangular plastic sheet 68 to the top surface of the manifold 64 to enclose the conduit 66. In the illustrated embodiment, the chassis 16 molded of high density polyethylene and the plastic sheet is low density polyethylene that is 0.002 inches thick. These two materials can be easily heat staked to one another using conventional methods and are also readily recyclable.

After the plastic sheet 68 is attached to the chassis 16, the sheet is folded and sealed around its two sides and top to form the flexible ink pouch 14. Again, in the illustrated embodiment, heat staking can be used to seal the perimeter of the flexible pouch 14. The plastic sheet 68 over the fill port 32 and over the inlet port 38 can be punctured, pierced, or otherwise removed so as not to block the flow of ink through these ports.

Although the flexible pouch 14 provides an ideal way to contain ink, it may be easily punctured or ruptured and allows a relatively high amount of water loss from the ink. Accordingly, to protect the pouch 14 and to limit water loss, the pouch 14 is enclosed within a protective shell 12. In the illustrated embodiment, the shell 12 is made of clarified polypropylene, which is sufficiently translucent to permit inspection of the ink within the pouch 14 to determine that an adequate volume of ink remains for proper operation of the printer. A thickness of about one millimeter has been found to provide robust protection and to prevent unacceptable water loss from the ink. However, the material and thickness of the shell may vary in other embodiments.

The top of the shell 12 has a number of raised ribs 70 to facilitate gripping of the shell 12 as it is inserted in or withdrawn from the docking bay. A vertical rib 72 projects laterally from each side of the shell 12. The vertical rib 72 can be received within a slot (not shown) in the docking bay to provide lateral support and stability to the ink supply when it is positioned within the printer. The bottom of the shell 12 is provided with two circumferential grooves or recesses 76 which engage two circumferential ribs or beads 78 formed on a depending perimetrical wall 79 of the chassis 16 to attach the shell 12 to the chassis 16 in a snap fit.

The attachment between the shell 12 and the chassis 16 should, preferably, be snug enough to prevent accidental separation of the chassis from the shell and to resist the flow of ink from the shell should the flexible reservoir develop a leak. However, it is also desirable that the attachment not form a hermetic seal to allow the slow ingress of air into the shell as ink is depleted from the reservoir 14 to maintain the pressure inside the shell generally the same as the ambient pressure. Otherwise, a negative pressure may develop inside the shell and inhibit the flow of ink from the reservoir. The ingress of air should be limited, however, in order to maintain a high humidity within the shell and minimize water loss from the ink.

In the illustrated embodiment, the shell 12 and the flexible pouch 14 which it contains have the capacity to hold approximately thirty cubic centimeters of ink. The shell is approximately 67 millimeters wide, 15 millimeters thick, and 60 millimeters high. The flexible pouch 14 is sized so as to fill the shell without undue excess material. Of course, other dimensions and shapes can also be used depending on the particular needs of a given printer.

To fill the device 10, ink can be injected through the fill port 32. As it is filled, the flexible pouch 14 expands so as to substantially fill the shell 12. As ink is being introduced into the pouch, the sealing ball 58 can be depressed to open the fluid outlet and a partial vacuum can be applied to the fluid outlet 20. The partial vacuum at the fluid outlet causes ink from the pouch 14 to fill the chamber 36, the conduit 66, and the bore of the cylindrical boss 54 such that little, if any, air remains in contact with the ink. The partial vacuum applied to the fluid outlet also speeds the filling process. To further facilitate the rapid filling of the pouch, an exhaust port 34 is provided to allow the escape of air from the shell as the reservoir expands. Once the ink supply is filled, a ball 35 is press fit into the fill port 32 to prevent the escape of ink or the entry of air.

Of course, there are a variety of other ways which can also be used to fill the present ink containment and dispensing device. In some instances, it may be desirable to flush the entire device with carbon dioxide prior to filling it with ink. In this way, any gas trapped within the device during the filling process will be carbon dioxide, not air. This may be preferable because carbon dioxide may dissolve in some inks while air may not. In general, it is preferable to remove as much gas from the device as possible so that bubbles and the like do not enter the print head or the trailing tube.

The protective cap 22 is placed on the device 10 after the reservoir is filled. The protective cap is provided with a groove 80 which receives a rib 82 on the chassis to attach the cap to the chassis. The cap carries a plug 84 which plugs the exhaust port 34 to limit the flow of air into the chassis and reduce water loss from the ink. A stud 86 extends from each end of the chassis 16 and is received within an aperture in the cap 22 to aid in aligning the cap and to strengthen the union between the cap and the chassis. The free ends of the studs 86, which extend beyond the apertures of the cap 22, are preferably deformed after the cap 22 is in place, for example, by contacting them with a heated tool, to provide a tamper resistant attachment of the cap 22 to the chassis 16.

Further, the label 24 is glued to the sides of the device 10 to hold the shell 12, chassis 16, and cap 22 firmly together. In the illustrated embodiment, hot-melt glue is used to adhere the label in a manner that prevents the label from being peeled off and inhibits tampering with the ink supply.

The cap 22 in the illustrated embodiment is provided with a vertical rib 90 protruding from each side. The rib 90 is an extension of the vertical rib 72 on the shell and is received within the slot provided in the docking bay in a manner similar to the vertical rib 72. In addition to the rib 90, the cap 22 has protruding keys 92 located on each side of the rib 90. One or more of the keys 92 can be optionally deleted or altered so as to provide a unique identification of the particular ink supply by color or type. Mating keys (not shown), identifying a particular type or color of ink supply can be formed in the docking bay. In this manner, a user cannot inadvertently insert an ink supply of the wrong type or color into a docking bay. This arrangement is particularly advantageous for a multi-color printer where there are adjacent docking bays for ink supplies of various colors.

Figure 10:
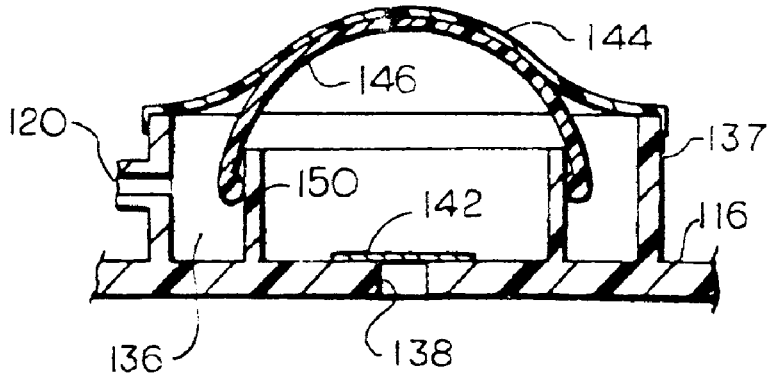
FIG. 10 is a fragmentary sectional view showing an alternative embodiment of the present invention.
Figure 11:
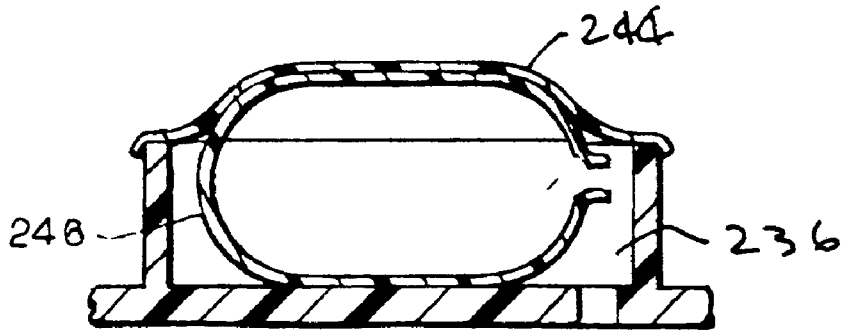
FIGS. 11–15 are views similar to FIG. 10 illustrating alternative embodiments of an element thereof.
Figure 12:
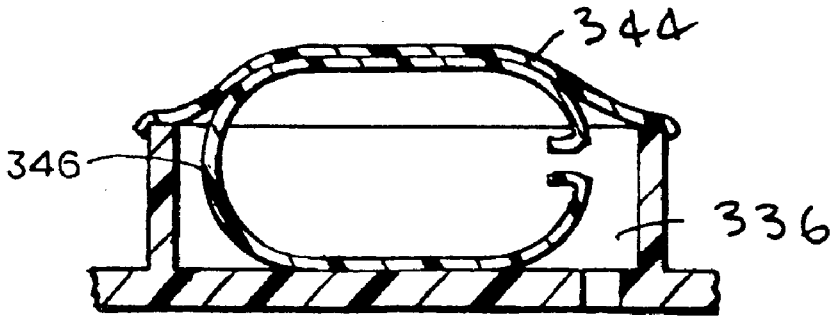
Figure 13:
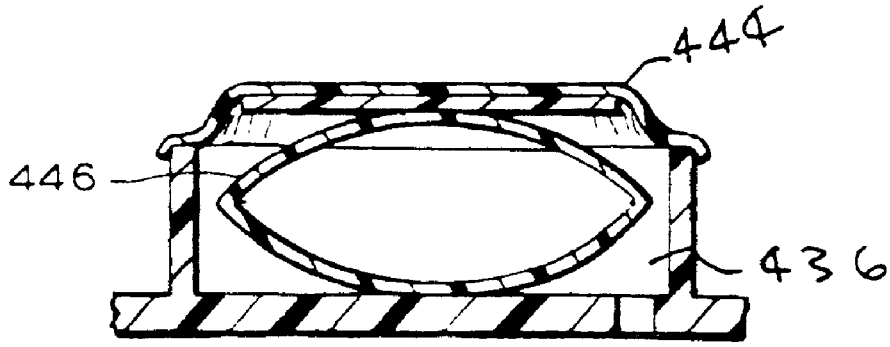
Figure 14:
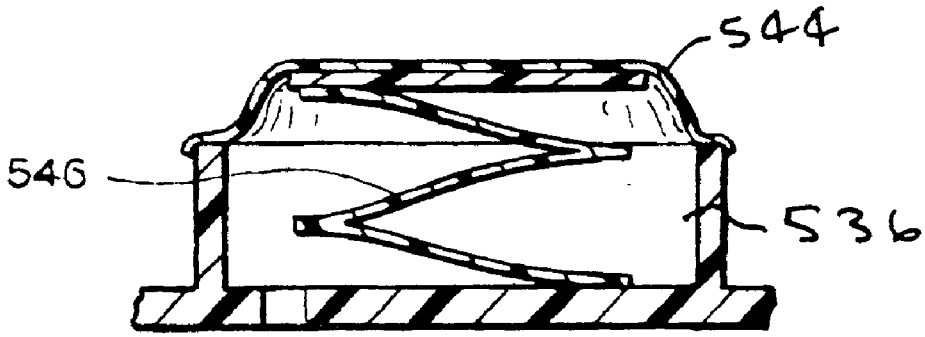
Figure 15:
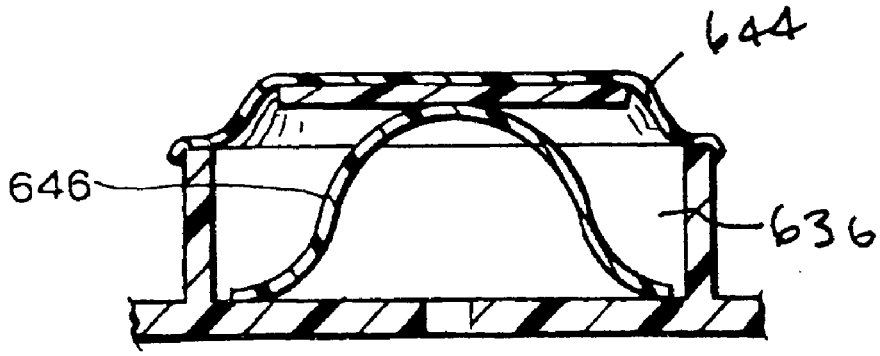

FIG. 10 illustrates an alternative embodiment of a pumping chamber 136 for use in place of the pumping chamber 36 of the embodiment of FIGS. 1–9. The pumping chamber 136 is defined by a rigid perimetrical wall 137, which is formed integrally with a chassis 116 from a polymeric material by injection molding. A pumping member 146, which is in the form of a leaf spring, can be deflected within the chamber, the leaf spring 146 thereby combining the functions of the separate pressure plate 46 and pump spring 48 of the embodiment of FIGS. 1–9 since the leaf spring 146 will self-return to its original or start position at the conclusion of a printing cycle. In any case, the interior of the pumping chamber is sealed by a flexible film 144 that overlies the leaf spring 146 and is sealed to the perimetrical wall 137, and incorporates a check valve 142, which corresponds in function, and may correspond in structure, to the check valve 42 of the embodiment of FIGS. 1–9. The leaf spring 146 is supported within the chamber 136 by a wall 150, which corresponds in function to the spike 50 of the embodiment of FIGS. 1 and 2. The pumping chamber 136 is also provided with an outlet 120 and an inlet port 138, which correspond in function to the outlet 20 and the inlet port 38, respectively, of the embodiment of FIGS. 1–9.

FIGS. 11–15 illustrate alternative springs 246, 346, 446, 546, 646, respectively, that can be used in place of the leaf spring 146 of the embodiment of FIG. 10. Each of the springs 246, 346, 446, 546, 646 can be readily formed from a suitable polymeric material by extrusion, and then cut to its desired width. When formed in this way, each of the springs 246, 346, 446, 546, 646 will be corrosion-resistant, unlike a metallic leaf spring 146 (or the spring 48) unless formed of stainless steel or other corrosion resistant metal. In any case, the springs 246, 346, 446, 546, 646 are contained within pumping chambers 236, 336, 436, 536, 636, respectively, which correspond in function to the pumping chambers 36, 136, and are covered by flexible films 244, 344, 444, 544, 644, respectively, which correspond in structure and function to the flexible films 44, 144.

The liquid containment and dispensing device of the present invention has been specifically described as a device for containing and dispensing a supply of printing ink in an ink jet printer as the preferred embodiment of the invention. However, it is also contemplated that the present invention can easily be adapted to the containment and dispensing of other Newtonian (low viscosity) liquids.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims and the legal equivalents thereof.

What is claimed:

1. In a liquid containment and dispensing device having a rigid, generally cup-shaped outer shell with an open end, a chassis secured to the open end of the shell, the chassis having a pumping mechanism with a liquid inlet thereinto and a liquid outlet therefrom and a cap overlying the chassis, the chassis being positioned between the cap and the shell, the improvement wherein said device further comprises:

a label, said label being adhesively joined to an exterior of the shell and an exterior of the cap and helping to permanently secure the cap, the chassis and the shell to one another.

2. In a liquid containment and dispensing device having a rigid, generally cup-shaped outer shell with an open end, a chassis secured to the open end of the shell, the chassis having a pumping mechanism with a liquid inlet thereinto and a liquid outlet therefrom, a flexible pouch having an open end and a closed end, the closed end being positioned within the shell and the open end being joined to the chassis in fluid communication with the pumping mechanism, a valve separating the flexible pouch into the pumping mechanism while preventing liquid flow from the pumping mechanism into the flexible pouch, to dispense liquid therefrom through the liquid outlet, the chassis having a top panel portion with an opening therein, the opening being in liquid communication with the pumping mechanism, the valve being a thin, flexible, rectangular film of a liquid impervious material overlying the opening in the top panel portion, the thin film being heat staked to the top panel portion so that a portion of the thin film is free to flex with respect to the top panel portion, the improvement wherein:

the thin film is heat staked to the top panel portion only between ends of an opposed pair of sides of the thin film.

3. A liquid containment and dispensing device according to claim 2 wherein each of the opposed pair of sides of the thin film is shorter than each of another opposed pair of sides of the thin film.

4. In a liquid containment and dispensing device having a rigid, generally cup-shaped outer shell with an open end, a chassis formed from a heat-softenable polymeric material secured to the open end of the shell, a pumping mechanism having a liquid inlet thereinto and a liquid outlet therefrom, the chassis having a top panel portion, and a cap secured to the chassis, the improvement wherein:

the chassis comprises a spaced apart pair of studs formed integrally therewith and extending outwardly therefrom;

the cap is provided with a spaced apart pair of apertures, each of the apertures receiving one of the studs, a free end of each stud projecting through the aperture in which it is received;

the cap being secured to the chassis by deforming the free end of each of the studs to enlarge it to create an interference between the free end and the aperture of the chassis in which it is received.

5. In an ink containment and dispensing device having a rigid, generally cup-shaped outer shell with an open end, a chassis secured to the open end of the shell, a pumping mechanism with an ink inlet thereinto and an ink outlet therefrom and a cap overlying the chassis, the chassis being positioned between the cap and the shell, the improvement wherein said device further comprises:

a label, said label being adhesively joined to an exterior of the shell and an exterior of the cap and helping to permanently secure the cap, the chassis and the shell to one another.

6. In an ink containment and dispensing device having a rigid, generally cup-shaped outer shell with an open end, a chassis secured to the open end of the shell, the chassis having a pumping mechanism with an ink inlet thereinto and an ink outlet therefrom, a flexible pouch having an open end and a closed end, the closed end being positioned within the shell and the open end being joined to the chassis in liquid communication with the pumping mechanism, a check valve separating the flexible pouch from the pumping mechanism and permitting ink flow from the flexible pouch into the pumping mechanism while preventing ink flow from the pumping mechanism into the flexible pouch, to dispense ink therefrom through the ink outlet, the chassis having a top panel portion with an opening therein, the opening being in liquid communication with the pumping mechanism, the check valve being in the form of a thin, flexible, rectangular film of a liquid impervious material overlying the opening in the top panel portion, the thin film being heat staked to the top panel portion so that a portion of the thin film is free to flex with respect to the top panel portion, the improvement wherein:

the thin film is heat staked to the top panel portion only between the ends of an opposed pair of sides of the thin film.

7. A liquid containment and dispensing device according to claim 6, wherein each of an opposed pair of sides of the thin film is shorter than each of another opposed pair of sides of the thin film.

8. In an ink containment and dispensing device having a rigid, generally cup-shaped outer shell with an open end, a chassis formed from a heat-softenable polymeric material secured to the open end of the shell, a pumping mechanism having an ink inlet thereinto and an ink outlet therefrom, the chassis having a top panel portion, and a cap secured to the chassis, the improvement wherein:

the chassis comprises a spaced apart pair of studs formed integrally therewith and extending outwardly therefrom;

the cap is provided with a spaced apart pair of apertures, each of the apertures receiving one of the studs, a free end of each stud projecting through the aperture in which it is received;

the cap being secured to the chassis by deforming the free end of each of the studs to enlarge it to create an interference between the free end and the aperture of the chassis in which it is received.

9. In an ink containment and dispensing device having a rigid, generally cup-shaped outer shell with an open end, a chassis secured to the open end of the shell, the chassis having a pumping mechanism with an ink inlet thereinto and an ink outlet therefrom, a flexible ink containment pouch having an open end and a closed end, the closed end being positioned within the shell and the open end being joined to the chassis in liquid communication with the pumping mechanism, a check valve separating the flexible pouch from the pumping mechanism and permitting ink flow from the flexible pouch into the pumping mechanism into the flexible pouch, the shell being formed of a rigid polymeric material and having a generally rectangular cross-section with a firs pair of opposed sides and a second pair of opposed sides, the sides of the first pair being substantially longer than the sides of the second pair, the improvement wherein:

each of the sides of the first pair is outwardly bowed.

10. In an ink containment and dispensing device according to claim 9, wherein the chassis has a perimetrical wall, the further improvement wherein:

the perimetrical wall fits snugly within the open end of the shell, one of the perimetrical wall and the open end of the shell having at least one radially outwardly projecting bead, the other of the open end of the chassis and the perimetrical wall having at least one radially inwardly projecting recess, the at least one bead being received in the at least one recess chassis in a snap fit.

* * * * *